United States Patent [19]

Niemiec

[11] Patent Number: 4,913,636

[45] Date of Patent: Apr. 3, 1990

[54] ROTARY VANE DEVICE WITH FLUID PRESSURE BIASED VANES

[75] Inventor: Albin J. Niemiec, Sterling Heights, Mich.

[73] Assignee: Vickers, Incorporated, Troy, Mich.

[21] Appl. No.: 253,731

[22] Filed: Oct. 5, 1988

[51] Int. Cl.[4] ..... F03C 2/22; F04C 2/344

[52] U.S. Cl. ..... 418/82; 418/133; 418/268

[58] Field of Search ..... 418/78, 82, 133, 267, 418/268

[56] References Cited

U.S. PATENT DOCUMENTS

| | | | |
|---|---|---|---|
| 2,937,599 | 5/1960 | Rosaen | 418/268 |
| 2,967,488 | 1/1961 | Gardiner | 418/81 |
| 3,869,231 | 3/1975 | Adams | 418/268 |
| 4,431,389 | 2/1984 | Johnson | 418/82 |
| 4,505,654 | 3/1985 | Dean, Jr. et al. | 418/82 |
| 4,629,406 | 12/1986 | Tantardini | 418/268 |

*Primary Examiner*—John J. Vrablik

*Attorney, Agent, or Firm*—Barnes, Kisselle, Raisch, Choate, Whittemore & Hulbert

[57] ABSTRACT

A fluid pressure energy translating device of the sliding vane type comprising a cam ring including an internal contour, a rotor having a plurality vanes rotatable therewith and slidable relative thereto in slots in the rotor with one end of each vane engaging the internal contour. The rotor and internal contour cooperate to define one or more pumping chambers between the periphery of the rotor and the cam contour through which the vanes pass carrying fluid from an inlet port to an outlet port. Two pressure chambers are formed for each vane and each vane has two surfaces one in each chamber, both being effective under pressure in the respective chambers to urge the vanes into engagement with the cam. Pressure sensing passages extend from the periphery of the rotor to one of the chambers to provide pressure to the chamber. The end of each vane is tapered with the radially outermost portion of the end extending in a trailing manner and each pressure sensing passage leads the respective vane with respect to the direction of rotation thereby sensing pressure ahead of each respective vane. The leading passages also provide paths for exhausting the undervane displacement to ensure hydrostatic bias on the vane and cause the vanes to contact the cam contour during the pressure transition and displacement zones.

12 Claims, 7 Drawing Sheets

$P > P_1$
WHEN LEADING VANE EXPOSES DISCHARGE PORT $P < P_1$
AT ALL POSITIONS OF VANES DURING INWARD DISPLACEMENT

ROTARY VANE DEVICE WITH FLUID PRESSURE BIASED VANES

This invention relates to power transmissions and particularly to fluid pressure energy translating devices such as pumps or motors.

BACKGROUND AND SUMMARY OF THE INVENTION

A form of pump and motor utilized in hydraulic power transmission comprises a rotor having a plurality of spaced radial vanes rotatable therewith and slidable relative thereto in slots provided in the rotor. The rotor and vanes cooperate with the internal contour of a cam to define one or more pumping chambers between the outer periphery of the rotor and the cam contour through which the vanes pass carrying fluid from an inlet port to an outlet port. Cheek plates are associated with each side of the cam and rotor through which the fluid flows to and from the rotor. The passages and grooves in the cheek plates along with the cam contour define the pump cycles or zones, namely, fill (inlet), precompression transition (inlet to pressure), displacement (discharge) and decompression (discharge to inlet).

It has heretofore been recognized that it is essential for efficient operation of the pump to apply a biasing pressure to a chamber at the underside of the vanes in order to maintain them in contact with the cam. In the past pressure has been applied continuously or intermittently to the undersides of the vanes. In the continuous pressure arrangement pressure is applied even when the vanes are in low pressure zones and has resulted in excessive cam and vane tip wear. In the intermittent pressure arrangement, pressure is applied to the vanes only when the vanes are in high pressure zones and only centrifugal force is utilized to urge the vanes toward the cam when the vanes are in low pressure zones; such a vane system is described in U.S. Pat. No. 3,869,231, which possesses one undervane surface that is subjected to intermittent pressure. As a result, the contact of the vanes with the cam is not positive during some portion of the travel so that efficiency and wear are adversely affected.

It has heretofore been suggested and commercial devices have been made wherein additional pressure chambers are associated with each vane. The chamber at the base of each vane is commonly known as the undervane chamber and is subjected to cyclically changing pressure. The additional chambers are commonly known as the intra-vane chambers and are subjected to continuous high pressure. Typical devices are shown in U.S. Pat. Nos. 2,919,651, 2,967,488, 3,102,494, 3,103,893, 3,421,413, 3,447,477, 3,645,654, 3,752,609, 4,431,389 and 4,505,654. In such an arrangement the contact of the vanes with the cam is controlled at all times by fluid pressure to the intra-vane and corresponding undervane chambers.

It has generally been thought that such systems operate most sufficiently at pressure applications of about 3,000 psi. However, in certain environments it is desirable to obtain higher pressures.

Accordingly, among the objectives of the present invention are to provide a pressure energy translating device in the form of a vane type pump or motor which will operate at higher pressures; which will have increased rotor segmental strength; which will have lesser tendency for vane pinch by the loaded rotor segments; which will be less sensitive to radial unbalance as a result of vane tip wear; which will provide strategic undervane porting to achieve more positive vane tracking of the cam contour; and which will provide a smaller diameter rotor thereby maximizing the rated speed (rpm).

In accordance with the invention a fluid pressure energy translating device of the sliding vane type comprises a cam ring including an internal contour, a rotor having a plurality of vanes rotatable therewith and slidable relative thereto in slots in the rotor with one end of each vane engaging the internal contour. The rotor and internal contour cooperate to define one or more pumping chambers between the periphery of the rotor and the cam contour through which the vanes pass carrying fluid from an inlet port to an outlet port. Two or more pressure undervane chambers are formed for each vane. One of these chambers is of a controlled area and is to continuous discharge pressure to urge the vanes into engagement with the cam. The leading (direction of rotation) pressure sensing passages extend from the periphery of the rotor and communicate the respective pressure of the intervane volume to the remaining undervane chamber during all the events of the pumping cycle. The end to each vane is tapered with the radially outermost portion of the end extending in a trailing manner. The leading passages also provide paths for exhausting the undervane displacement to ensure hydrostatic bias on the vane; this biased pressure is distributed to cause the vanes in the discharge zone to maintain contact on the cam contour.

DESCRIPTION

Figure 1:
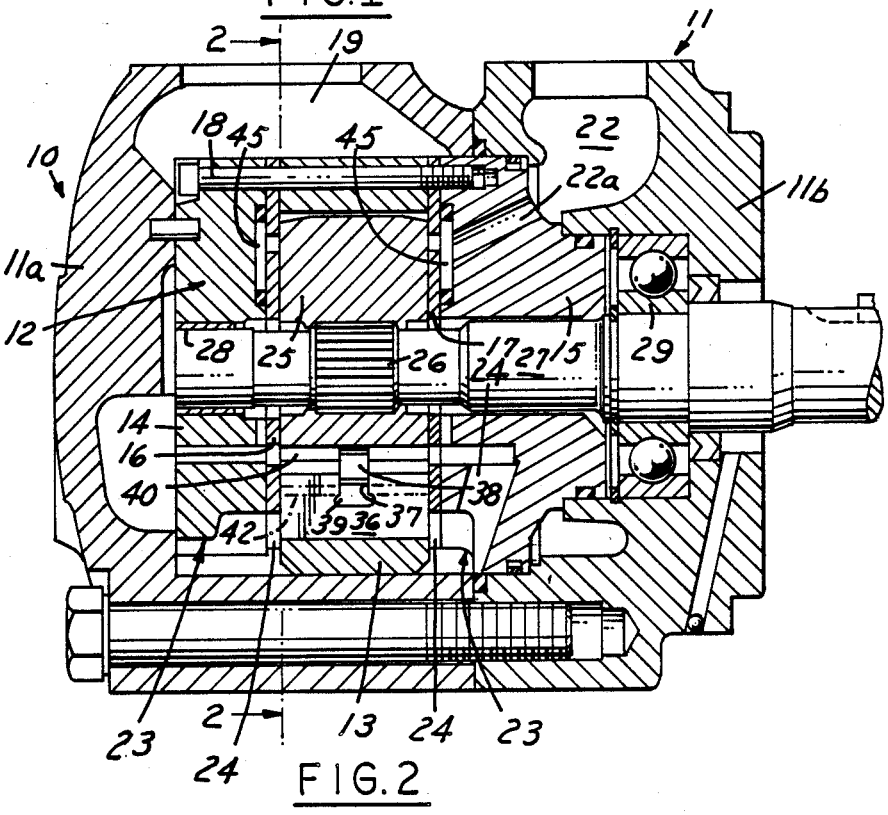
FIG. 1 is a longitudinal sectional view through a pressure energy translating device embodying the invention.
Figure 2:
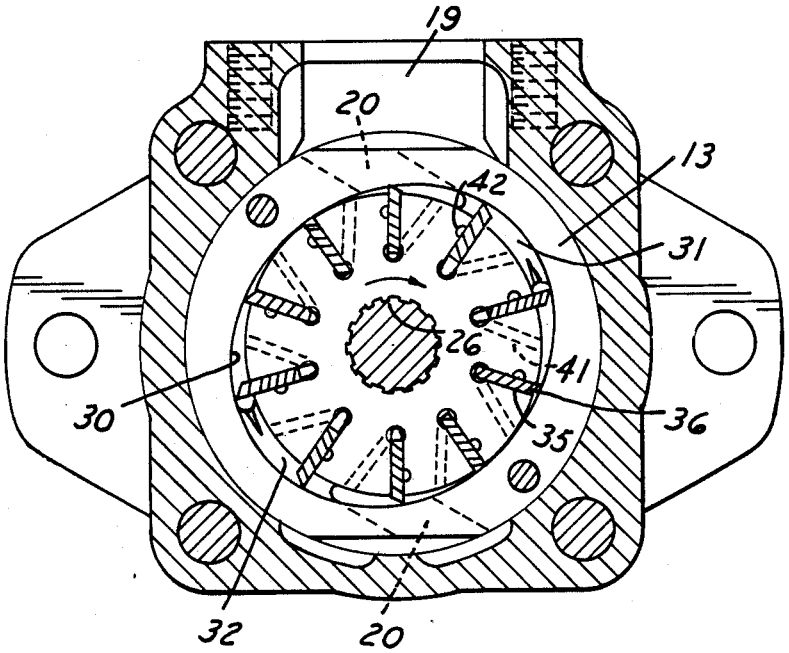
FIG. 2 is a sectional view taken along the line 2—2 in FIG. 1.

Referring to FIGS. 1 and 2, there is shown a rotary sliding vane device or pump 10 comprising a casing 11 and a cartridge or subassembly 12. Casing 11 comprises a body 11*b* and a cover 11*a*. The cartridge 12 includes a cam ring 13 sandwiched between support plates 14, 15 with intermediate cheek plates 16, 17, all of which are secured to each other by bolts 18 extending through support plate 14 and cam 13 into threaded holes in support plate 15. The cover 11*a* is provided with an inlet supply connection port 19 leading into a pair of fluid port inlet openings 20 in cam 13, as shown in FIG. 2, and passages 23 formed in the support plates 14 and 15 as shown in FIG. 1 and recesses 24, in the cheek plates 16 and 17 as shown in FIGS. 1 and 2.

An outlet connection port 22 is provided in the body 11*b* which is directly connected by a passage 22*a* to a pressure delivery chamber formed in support plate 15 and passages 48 in the cheek plates 16 and 17.

A rotor 25 is rotatably mounted within the cam 13 on the splined portion 26 of a shaft 27 which is rotatably mounted within a bearing 28 in the support plate 14 and a ball bearing 29 mounted with the body 11*b*.

Cam 13 has an internal contour 30 which is substantially oval in shape and which together with the periphery of the rotor 25 and the adjoining surfaces of the cheek plates 16, 17 define two opposed pumping chambers 31, 32, each of which traverse the fluid inlet, fluid transition, and fluid outlet zones. The fluid inlet zones comprise those portions of the pumping chambers or spaces 31, 32, respectively, registering with the fluid inlet port openings 20 and cheek plate passages 24. The fluid delivery zones comprise those portions of the pumping chambers 31, 32 registering, respectively, with opposed arcuately shaped fluid delivery port openings 48 in cheek plates 16, 17 which are directly connected to the outlet connection port 22. Fluid flows to the inlet zones through inlet port openings 20 and also through the passages 23 formed in the support plates 14, 15 and recesses 24 in the cheek plates 16, 17 which permit the fluid to flow from the inlet 19 between the sides of cam 13.

The pumping device so far described is of the well known structure disclosed in the U.S. Pat. No. 2,967,488. It has been the practice in devices of this type to provide the rotor with a plurality of radial vane slots 35, each of which has a vane 36 slidably mounted therein. The outer end or vane tip of vanes 36 engage the inner contour of cam 13. The contour of cam 13 includes an inlet rise portion, an intermediate arcuate portion, an outlet fall portion, and another intermediate arcuate portion. The cam contour is symmetrical about its minor axis, thus each of the rise, fall and arcuate portions are duplicated in the other opposed portion of the contour. As the tips of vanes 36 carried by the rotor 25 and the vane tips traverse the outlet fall portions, the vanes 36 move radially inward. The spacing between each pair of vanes 36 is adapted to span the distance between each pair of ports in a manner to provide proper sealing between the inlet and outlet chambers of the pumping device.

Each vane 36 has a rectangular notch 37 extending from the inner end or base of the vane to substantially the mid-section thereof. A reaction member 38 comprises a flat sided blade substantially equal in width and thickness to that of the notch 37 in the vane so as to have a sliding fit within the vane and the side walls of each rotor vane slot 35. The side walls of the rotor vane slot 35, the vane 36 and the reaction member 38 define an expansible intra-vane chamber 39. An undervane pressure chamber 40 is defined by the base of each vane 36 and the base and side walls of each rotor vane slot 35. Chambers 39 and 40 are separated by and sealed from each other by reaction member 38. Thus, the two chambers 39, 40 are provided substantially the same as shown in U.S. Pat. No. 2,967,488 which is incorporated herein by reference.

Referring to FIGS. 1 and 2, the undervane chamber 40 associated with the base of each vane 36 is provided with fluid pressure by radial passage 41 in rotor 25. The radial passages 41 transmit fluid to the undervane chambers 40 and, thus, to the bases of the vanes 36. Thus, the cyclically changing pressure which is exerted on the tips of the vanes 36 as they traverse the inlet and outlet portions of the cam contour is transmitted to the bases of the vanes 36.

Fluid under pressure is supplied to the chamber 39 by transverse slots 42 in rotor 25 which communicate with arcuate grooves 44 in each face of each cheek plate 16, 17. Each groove 44 extends about a portion of the travel of rotor 25. Grooves 43 are provided in the displacement zones in concentric relation with the grooves 44 for registry with the slots 42. A pressure balancing pad 45 is provided on the opposite face of the cheek plate and is circumscribed by a seal. An opening 46 extends through the plate and communicates each groove 43 with the pressure pad 45. Two openings 47 extend through the plate and provide communication between groove 44 and pressure pad 45. As the axial slots 42 move across the arcuate grooves 43 the displaced fluid at the intra-vane chamber 39 is transmitted to and is exhausted through the restricted opening 46 and into the cavity of the pressure balancing pad 45. The resulting increased fluid pressure is transmitted to the intra-vane chambers 39 and acts to hold the reaction members 38 against the base of the undervane chamber 40 and also holds the vane on the cam 13.

Figure 16:
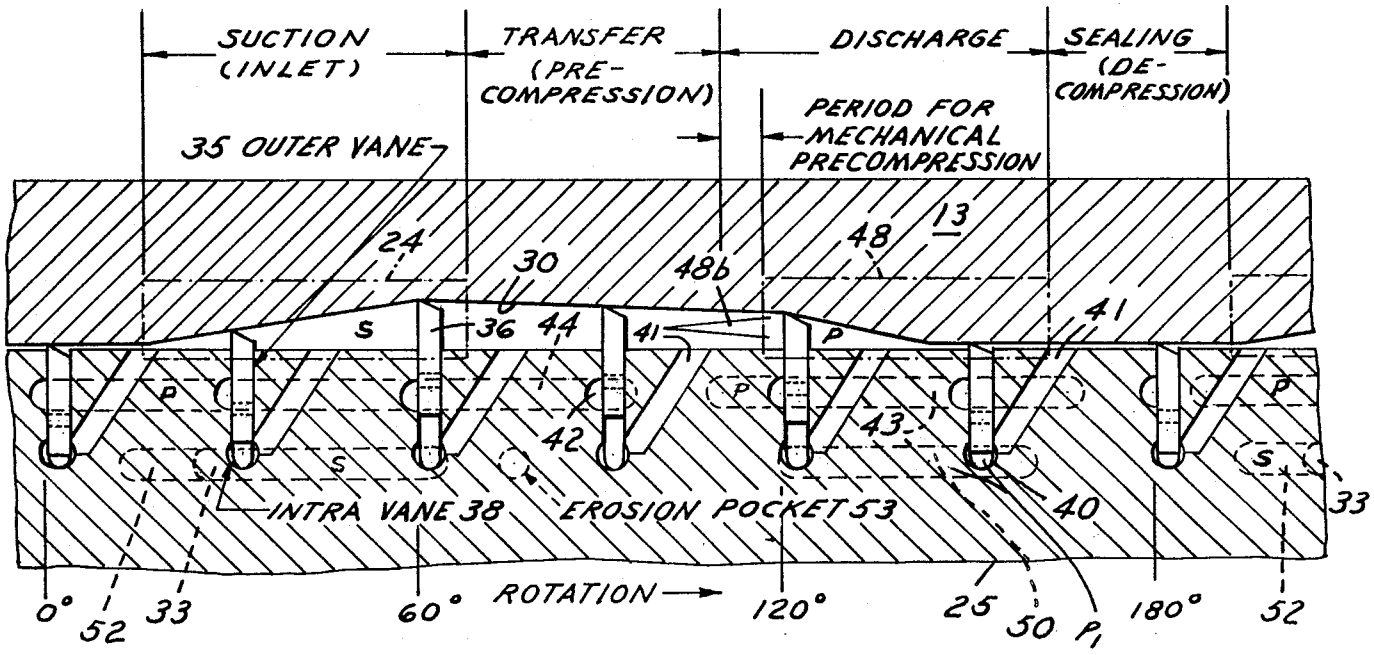
FIG. 16 is a linear layout of the pumping events.

As shown in FIG. 16 each vane moves successively through the fluid inlet zone, the fluid precompression zone, the fluid discharge zone, and the fluid decompression zone. Groove 44 associated with the intra-vane chambers 39 provides communication between adjacent intra-vane chambers as the vane moves through a portion of the decompression zone, the inlet zone, and a portion of the precompression zone. Groove 43 associated with the intra-vane chambers 39 provides communication between adjacent intra-vane chambers as the vanes thereafter move through a portion of the precompression zone and the discharge zone. Groove 33 associated with the undervane chambers 40 provides communication between adjacent undervane chambers as the vanes move through the inlet zone. Groove 50 provides communication between the undervane chambers 40 as the vanes move through the discharge zone.

During the pumping the cycles, the internal pressure distribution between the rotating group and the cheek plates is equalized or slightly exceeded by the hydrostatic pressure force of the balancing pads 45. This feature is described in U.S Pat. No. 3,752,609.

On the inlet rise portions of the cycle, the passages 41 function to maintain pressure at the inlet pressure. On the outlet fall portion of the cycle, passages 41 function to increase the undervane pressure and retard the radially inward movement of the vanes to maintain the vanes in contact with the cam 13. On the minor dwell portion of the cycle between the outlet and inlet zones, the passages 41 function to decompress the volume not displaced. During the inlet to pressure transition, passage 41 in combination with the axial slot 42 encase the vane with a pressurized fluid film to ease the vane movement and to prevent the loaded rotor segment from pinching the vane in the rotor slot.

Although the invention has been described as used in a pump, it can also be used in a motor of the sliding vane type.

Figure 4:
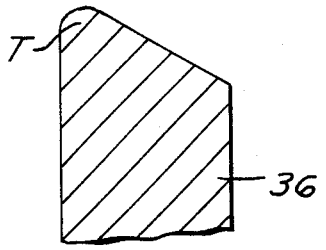
FIG. 4 is a fragmentary sectional view of the free end of a vane.

In accordance with the invention, the vanes 36 which have an end configuration such as shown in FIG. 4 are reversed in the slots 35 from the normal position in the prior art so that the radially outermost top portion T trails with respect to the direction of rotation. In addition, the pressure sensing passages 41 in the rotor 25 are positioned in advance of the respective vanes 36 with the respect to the direction of rotation so that they sense the pressure ahead of the vanes 36 and provide the fluid at that pressure to the appropriate chamber associated with the respective vane. The leading passages 41 also provide the path for exhausting the undervane displacement to ensure hydrostatic pressure bias on the vanes. This biased pressure is distributed in groove 50 to provide the added radial hydrostatic support for the vane in the displacement zone.

It has been found that the resultant construction will permit operation at a higher pressure without significantly enlarging the radial size of the rotor. In addition, the operation will be without excessive noise, reduce the tendency of the vanes to wear in the rotor slots, will provide less sensitivity to radial unbalance as a result of vane tip wear and will provide more positive vane tracking of the cam contour.

Figure 5A:
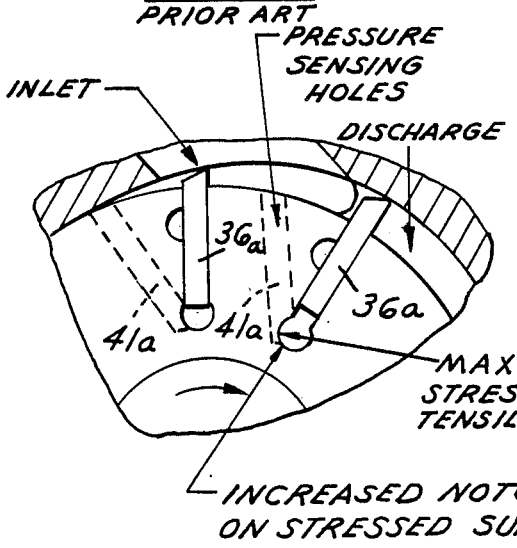
FIG.5A PRIOR ART
FIGS. 5A and 5B are diagrammatic views of the prior art and the present device showing the stresses in the rotor.
Figure 5B:
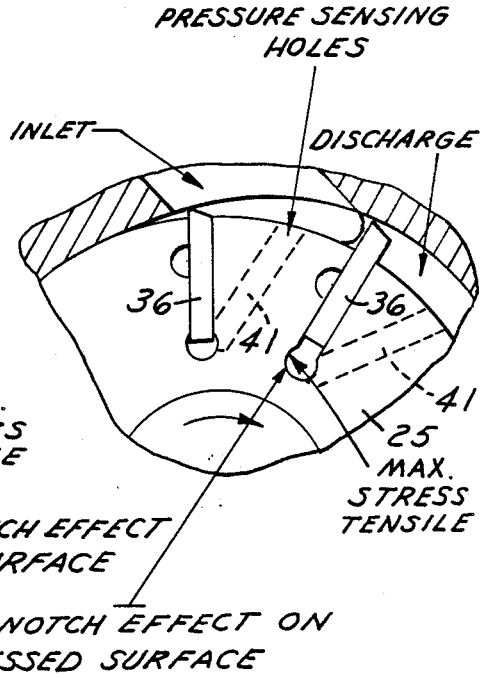

FIGS. 5A and 5B are diagrammatic views of the prior art and the present device, respectively. In the prior art, the stress at the base of the slots 35 produces a tensile stress whereas the stress at the corresponding portion of the rotor 25 of the present device produces a compressed stress at the inner ends of the radial passages 41 which intersect the vane slots 35. It has been found that on repeated cycle testing the fatigue strength of the rotor substantially improved in pumps embodying the invention.

Figure 6A:
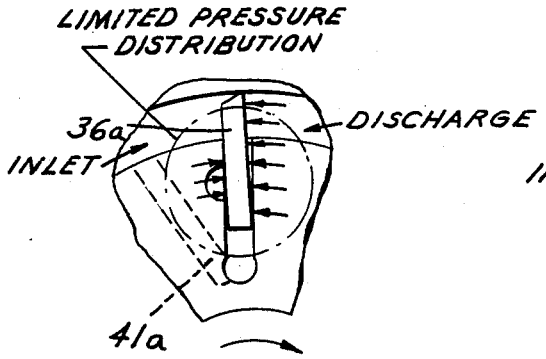
FIG.6A PRIOR ART
FIGS. 6A and 6B are diagrammatic views of the prior art and the present device showing pressure distribution along the vanes.
Figure 6B:
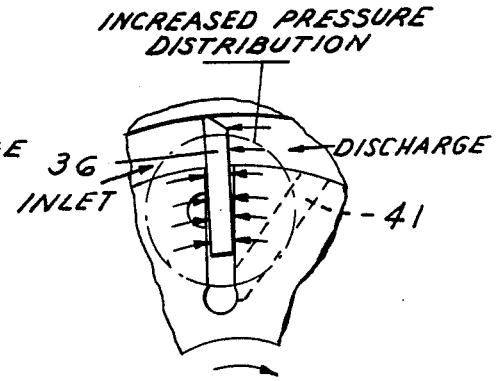

Referring to FIGS. 6A and 6B, which are diagrammatic views of the prior art and the present device, it has been found that since the undervane chambers 40 sense pressure ahead of the vanes 36, the vane slots 35 become completely pressurized more quickly during the inlet to discharge transition, as compared with the prior design. As a result there is less coulomb friction and wear during the beginning of the inward displacement cycle as represented by the pressure distribution arrows.

Figure 7A:
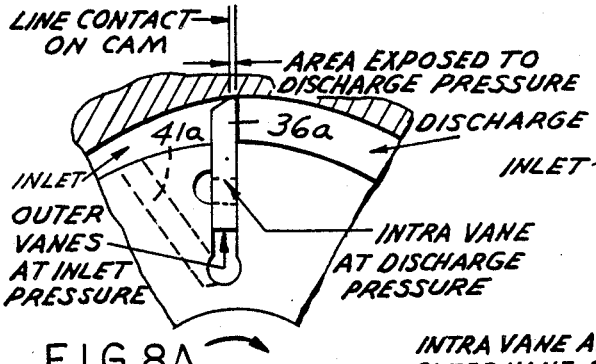
FIG.7A PRIOR ART
FIGS. 7A and 7B are diagrams of the prior art and the present device showing the effect of vane wear on the device.
Figure 7B:
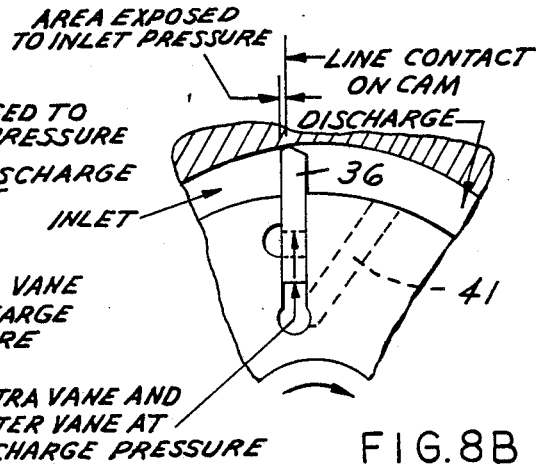

Referring to FIGS. 7A and 7B, which are diagrammatic views of the prior art and the present device, in the present device the discharge pressure is sensed ahead of the vane 36 and communicated beneath the vane 36. In addition to centrifugal force, the radial outward force on the vane 36 is a product of the discharge pressure acting on the undervane area; also included is the force of the system pressure acting on the intra-vane area. The total inward radial force on the vane "in the transition zone" (inlet to discharge) is the product of the discharge pressure on the vane tip area. The amount of the exposed vane tip area is determined by the location of the line contact of the vane tip tracking the cam contour. As the vane tip wears, the line contact shifts and reduces the amount of the area exposed to the internal discharge pressure and the net outward force becomes proportionately larger.

In the prior art intra-vane pump designs the vane tip wear, with consequent shifting of the line contact on the cam contour, causes a reduction in the net outward force upon the vane. When the exposed area of the vane tip exceeds that of the intra-vane, vane instability can be expected.

Figure 8A:
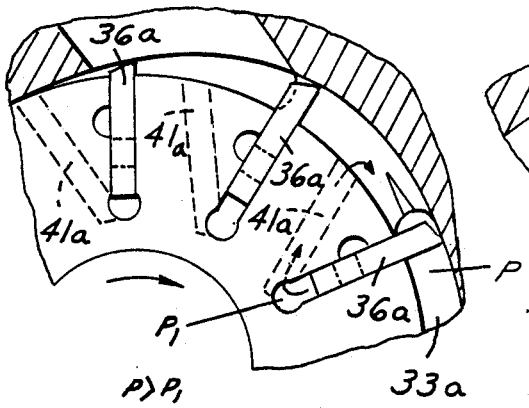
FIG.8A PRIOR ART
FIGS. 8A and 8B of diagrammatic views of the prior art and the present device showing the relative pressures on the device.
Figure 8B:
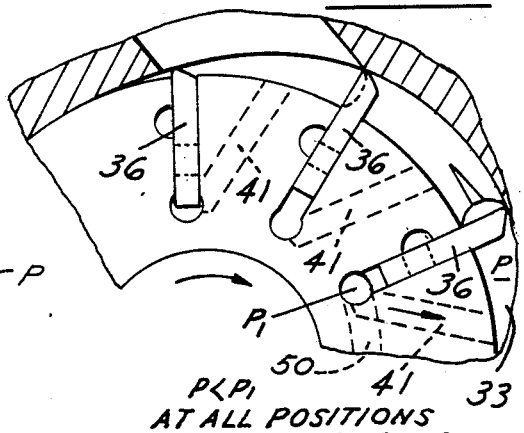

Referring to FIGS. 8A and 8B, which are diagrammatic views of the prior art and the present designs, it can be seen that in the prior art designs as shown in FIG. 8A the undervane volume is displaced into the trailing common chambers between the extended vane as shown in FIG. 8A.

The pressure $P_1$ in the undervane chambers entering the discharge zone is momentarily lower than discharge pressure P because of the inherent pressurizing delay caused by the pressure sensing passages 41 completing the inlet to discharge transition. Also the discharge pressure P includes the added potential energy due to the discharge flow changing direction from tangential flow to axial flow; this added pressure becomes more pronounced with increased shaft speeds. If the discharge pressure P is greater than $P_1$, there will be a tendency for the vane entering the discharge zone to become unstable.

In the present design FIG. 8B, the undervane displacement is directed into the leading passages 41 which communicate directly into the pump discharge chamber.

Since the undervane displacement originates at the vane, the pressure $P_1$ has to be greater than the pressure P in the discharge chamber. The resulting net force bias will maintain the vane on the cam contour.

In the prior design FIG. 8A, the discharge flow from the intra-vane chamber was restricted in the attempt to stabilize the vane in the discharge quadrant. This feature was limited because this displaced volume was relatively small and its discharge pressure was difficult to control (increase) because of the inherent leakage paths of the axial clearances between the cheek plates and the rotating group.

Figure 3:
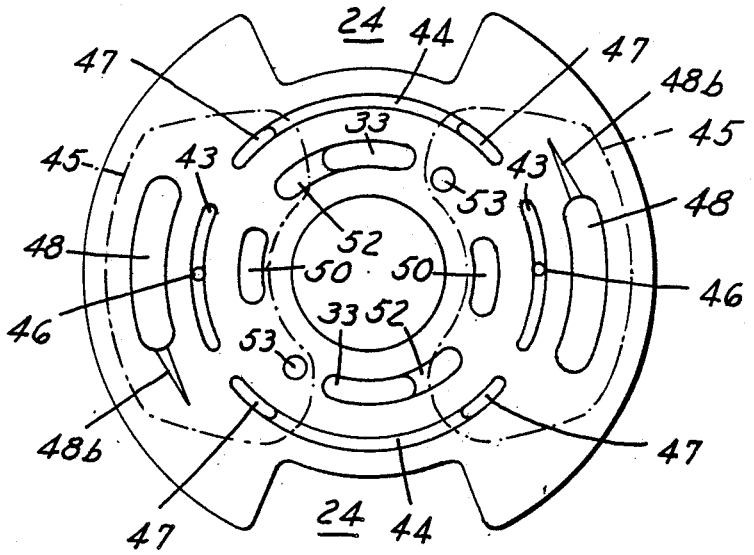
FIG. 3 is a plan view of a pressure plate utilized in the device.

In order to optimize the functioning of the passages 41 which lead the vanes 36, undervane arcuate discharge grooves 50 are provided in each cheek plate (FIG. 3). These grooves 50 function to communicate the increased undervane pressures to the vanes 36 in the discharge zone and the vanes entering the pressure inlet transition zone, thereby assuring continuous vane contact on the cam contour 13.

Figure 9:
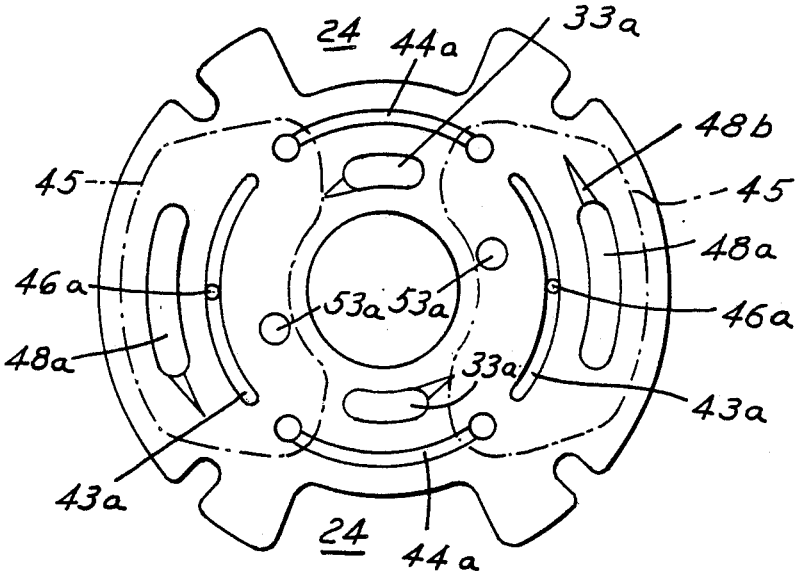
FIG. 9 PRIOR ART
FIG. 9 is a plan view of a prior art pressure plate.

In addition, a decompression groove 52 of uniform cross section is extended from the undervane filling openings 33. The grooves 52 are positioned such that the passages 41 are exposed to the grooves 52 and the spaces 31 and 32 thereby provide early decompression of the scavenged volume between the vanes and in the passages 41 and also provide early filling of undervane chambers. This may be contrasted to the prior art cheek plate as shown in FIG. 9 wherein the opening **33*a* provides a shorter period for filling the undervane chamber. Each cheek plate is also provided with a pressure metering groove 48*b* associated with filling openings 48** to control the rate at which the volume is brought up to pressure during the discharge transition period.

During the displacement cycle, a period of mechanical precompression is applied to the intervane volume about to be displaced. The principal purpose is to reduce the outgassing of the throttled flow admitted by the metering groove 48*b*. The mechanical precompression is controlled by delaying the combined openings of the metering groove 48*b* and port 48. The leading porting passages 41 permit this precompression because the anticipated pressure delay between the vane tip and the undervane occur at the trailing vane and not at the leading vane which provides the seal between inlet and discharge. (FIG. 16) With the prior art vane pump design (passages 41 trailing the vanes) the anticipated momentary pressure (created by the mechanical precompression) unbalance would occur at the leading vane which provides the critical sealing between the inlet and discharge.

Although the grooves and pockets have been shown in cheek plates, they can be provided in fixed portions of the housing if flexible cheek plates are not used.

In addition, the cheek plate embodying the invention includes erosion control pockets 53 in the area near the inlet in order to permit dissipation of the formation of bubbles in a pressure-inlet transition and accordingly prevent erosion damage to the critical surface of the cheek plates (FIG. 3). This may be contrasted to the prior art plate wherein the erosion pockets 53*a* are nearer the discharge than the inlet (FIG. 9).

Figure 13:
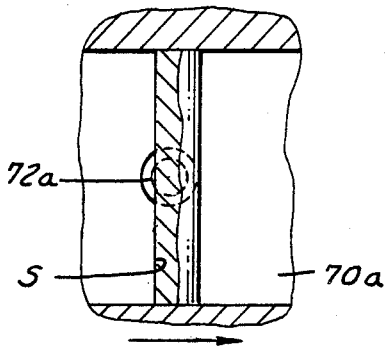
FIG. 13 PRIOR ART
FIG. 13 is a fragmentary sectional view taken along the line 13—13 in FIG. 12.
Figure 12:
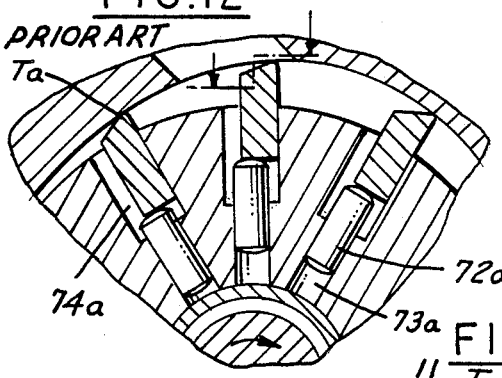
FIG. 12 PRIOR ART
FIG. 12 is a fragmentary sectional view of another prior art device.
Figure 11:
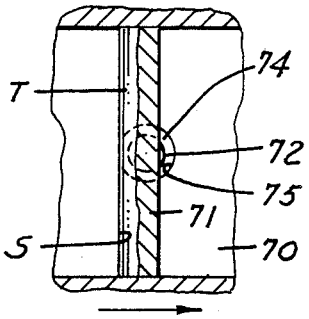
FIG. 11 is a fragmentary sectional view taken along the line 11—11 in FIG. 10.
Figure 10:
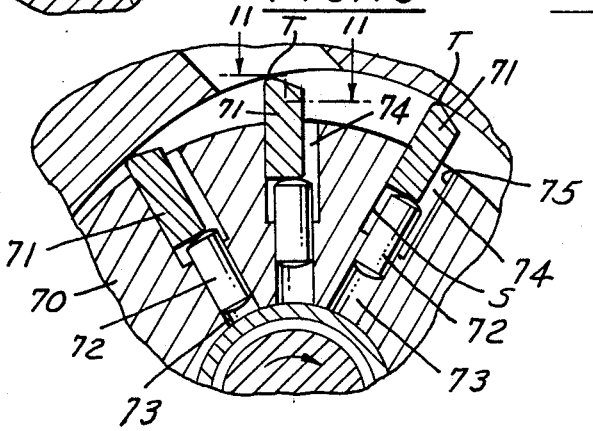
FIG. 10 is a fragmentary sectional view of a modified device embodying the invention of the type shown in FIG. 10.

Although the invention has been described in connection with pressure energy translating devices that have the intervane chamber provided as shown in FIG. 1, the invention is also applicable to other types of vane type pressure energy translating devices such as shown in the aforementioned patents wherein there are two chambers associated with the vane. Thus, as shown in FIGS. 10 and 11, the pressure energy translating device 70 includes vanes 71 positioned so that the tip 71*a* trails the direction of rotation. Pins 72 engage the base of the vanes and pockets 73 are provided to urge the pins radially outwardly. A passage 74 is defined by grooves 75 in the rotor and leads the respective vanes 71 in the direction of rotation. This such pressure energy translating device is shown in U.S. Pat. No. 4,629,406 and is of the general type shown in FIGS. 12 and 13 wherein identical parts have the same reference numbers with the suffix "a". As shown in FIGS. 12 and 13, the passages 74*a* trail the vanes 71*a* and the tips Ta lead the vane. As shown in FIG. 13 in the prior art, the maximum of area pressure defined by the surface S of the vane slot is interrupted by the passage 72*a*. This may be contrasted to FIG. 11 wherein in the pressure energy translating device embodying the invention the surface S is continuous without interruption, thereby providing a greater load bearing area in addition to the other advantages in the present invention.

Figure 14:
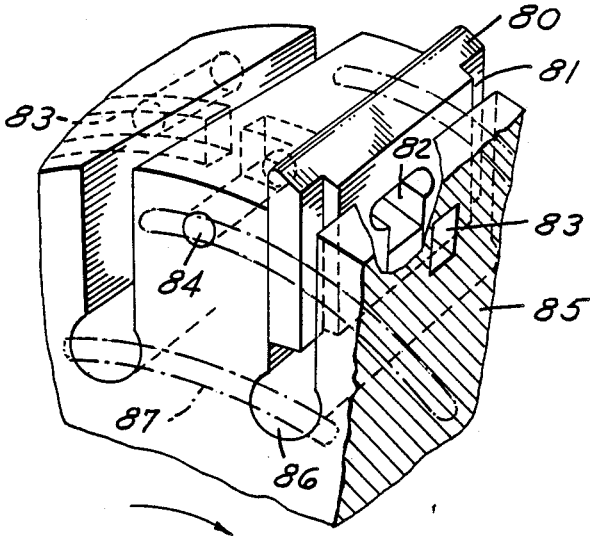
FIG. 14 is a fragmentary sectional perspective view of a modified device.

In the modified form shown in FIG. 14, the vanes 80 have portions 81 at their ends cut away to define radial passages which lead with respect to the direction of movement of the vanes 81 and the tips formed in the manner as shown in FIG. 2. In this form, the vanes are formed with intra-vane chambers 82 that communicate with one another through a circumferential passage 83 that in turn communicates with the periphery of the rotor which communicates through passage 84 with the periphery of the rotor 85. The undervane chambers 86 communicate with the groove 87 in the cheek. This form is otherwise similar to that disclosed in the U.S. Pat. No. 4,431,389 which is incorporated herein by reference.

Figure 15:
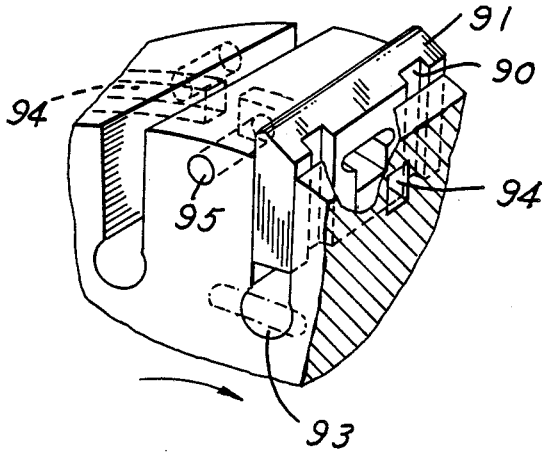
FIG. 15 is a fragmentary sectional perspective view of a modified device.

In the form of the invention shown in FIG. 15 the leading passages are in the form of grooves 90 in the vanes 91. Each vane is formed with an intra-vane chamber 92 and an undervane chamber 93 which communicate with passages 94 and 95 as in the form shown in FIG. 14; otherwise this form is identical to that shown in U.S. Pat. No. 4,505,654 which is incorporated herein by reference.

In both of the forms shown in FIGS. 14 and 15 the position of the vanes is reversed with respect to the direction of rotation so that the apex of the vane is in a trailing direction with respect to the direction of rotation. In this form of the invention shown in FIGS. 14 and 15 the trailing interrupted surface between the vane and rotor slot provides a superior load bearing support.

I claim:

1. A fluid pressure energy translating device of the sliding vane type comprising:

a cam ring including an internal contour, a rotor having a plurality of vanes rotatable therewith and slidable relative thereto in slots in the rotor with one end of each vane engaging the internal contour, said rotor and cam having an internal contour configured to define one or more pumping chambers between the periphery of the rotor and the cam contour through which the vanes pass carrying fluid from an inlet port to an outlet port, each said pumping chamber having a fluid inlet zone, a fluid precompression zone, a fluid discharge zone, and a fluid decompression zone, means defining at least two pressure chambers for each vane, each vane having at least two surfaces, one in each chamber, both being effective under pressure in the respective chambers to urge the vanes into engagement with the cam, one of said pressure chambers comprising an undervane chamber adjacent the inner end of each vane and the other of said pressure chambers comprising an intra-vane chamber intermediate the ends of each vane, pressure sensing passages extend from the periphery of the rotor to one of the chambers to provide pressure to the chamber, the end to each vane being tapered with the radially outermost portion of the end extending in a trailing manner and each pressure sensing passage leading the respective vanes with respect to the direction of rotation thereby sensing pressure ahead of each respective vane as the vane moves successively through the fluid inlet zone, the fluid precompression zone, the fluid discharge zone, and the fluid decompression zone, means for supplying fluid to the inlet zone of the cycle, means for delivering fluid from the discharge zone of the cycle, first means associated with the intra-vane chambers for providing communication between adjacent intra-vane chambers as the vanes move through a portion of the decompression zone, the inlet zone and a portion of the precompression zone, second means associated with the intra-vane chambers for providing communication between adjacent intra-vane chambers as the vanes thereafter move through a portion of the precompression zone and the discharge zone, third means associated with said undervane chambers for providing communication between adjacent undervane chambers as the vanes move through the inlet zone, and fourth means for providing communication between the undervane chambers as the vanes move through the discharge zone.

2. The fluid pressure energy translating device set forth in claim 1 including precompression zone contour including a portion providing mechanical precompression.

3. The fluid pressure energy translating device set forth in claim 2 including means for metering discharge pressure to said mechanical precompression zone.

4. The fluid pressure energy translating device set forth in claim 1 wherein said first and second means associated with said intra-vane chambers comprises a first passage and a second passage.

5. The fluid pressure energy translating device set forth in claim 4 wherein said first passage and second passage comprise circumferentially spaced arcuate first and second grooves in a cheek plate associated with said rotor.

6. The fluid pressure energy translating device set forth in claim 1 wherein said third and fourth means associated with said undervane chambers comprise a third passage and a fourth passage.

7. The fluid pressure energy translating device set forth in claim 6 wherein said third passage and said fourth passage comprise circumferentially spaced third and fourth grooves in a cheek plate associated with the rotor.

8. The fluid pressure energy translating device set forth in claim 1 including an erosion pocket adapted to communicate with an undervane chamber at the portion of the precompression zone.

9. The fluid pressure energy translating device set forth in any of claims 1–8 wherein said pressure sensing passages are provided in said rotor.

10. The fluid pressure energy translating device set forth in any of claims 1–8 wherein said pressure sensing passages are provided in a space between each said vane and said rotor.

11. The fluid pressure energy translating device set forth in any of claims 1–8 wherein said pressure sensing passage is in the form of a space at the axially outermost edges of the vanes.

12. The fluid pressure energy translating device set forth in any of claims 1–8 wherein said pressure sensing passages are in the form of grooves in said vanes extending radially thereof.

* * * * *